US009489915B2

(12) United States Patent
Chang

(10) Patent No.: US 9,489,915 B2
(45) Date of Patent: Nov. 8, 2016

(54) DISPLAY METHOD, DISPLAY DEVICE AND COMPUTER SYSTEM

(71) Applicant: Wistron Corporation, New Taipei (TW)

(72) Inventor: Yao-Tsung Chang, New Taipei (TW)

(73) Assignee: Wistron Corporation, New Taipei (TW)

( * ) Notice: Subject to any disclaimer, the term of this patent is extended or adjusted under 35 U.S.C. 154(b) by 21 days.

(21) Appl. No.: 14/608,199

(22) Filed: Jan. 29, 2015

(65) Prior Publication Data

US 2016/0140929 A1 May 19, 2016

(30) Foreign Application Priority Data

Nov. 18, 2014 (TW) ..... 103139964 A

(51) Int. Cl.

| | |
|---|---|
| ***G09G 5/00*** | (2006.01) |
| ***G09G 5/02*** | (2006.01) |
| ***G09G 5/391*** | (2006.01) |
| ***G09G 3/20*** | (2006.01) |

(52) U.S. Cl.

CPC ..... *G09G 5/005* (2013.01); *G09G 3/20* (2013.01); *G09G 5/02* (2013.01); *G09G 5/391* (2013.01)

(58) Field of Classification Search

None

See application file for complete search history.

(56) References Cited

U.S. PATENT DOCUMENTS

| | | | | |
|---|---|---|---|---|
| 2004/0239698 | A1* | 12/2004 | Kamada | G09G 3/3607 715/714 |
| 2015/0015590 | A1* | 1/2015 | Jeong | G09G 3/2003 345/502 |
| 2015/0070256 | A1* | 3/2015 | Gu | G09G 3/3413 345/88 |
| 2015/0248866 | A1* | 9/2015 | Tsunashima | G09G 3/3607 345/694 |

FOREIGN PATENT DOCUMENTS

TW 201405537 A 2/2014

OTHER PUBLICATIONS

Office action mailed on Jan. 13, 2016 for the Taiwan application No. 103139964, filing date Nov. 18, 2014, p. 1 line 13-14, p. 2-9 and p. 10 line 1-10.

* cited by examiner

*Primary Examiner* — Hilina K Demeter

(74) *Attorney, Agent, or Firm* — Winston Hsu; Scott Margo

(57) ABSTRACT

A display method for a display device to display a display information includes receiving the display information to generate a first classification group display information and a second classification group display information; and displaying the first classification group display information at a first display zone in a first display period and displaying the second classification group display information at a second display zone in a second display period; wherein the display device corresponds to a matrix and a plurality of matrix units of the matrix correspond to a plurality of display units, such that the plurality of display units of the first display zone neighbor with the plurality of display units of the second display zone and both are disposed at different matrix units with different column or row information.

12 Claims, 12 Drawing Sheets

DISPLAY METHOD, DISPLAY DEVICE AND COMPUTER SYSTEM

BACKGROUND OF THE INVENTION

1. Field of the Invention

The present invention relates to a display method, a display device and a computer system, and more particularly, to a display method, a display device and a computer system which controls different display units at different locations and different periods.

2. Description of the Prior Art

The recent display devices have been developed to high resolution pixels, e.g. developing from Full HD (High Definition) (1920*1080) resolution to UHD (Ultra HD) (3840*2160 or 4096*2160) 4K resolution. Accordingly, the elevated resolution of the display devices assists the display pixels to be applied to large-size display devices with 4K resolution. However, the improved resolution of the display devices may need to install more display pixels, which might increase more costs.

Under such circumstances, in order to adaptively control the number of the display pixels, the conventional solution is to utilize a plurality of sub-pixels for demonstrating the display pixels. For example, Samsung in Korea adopts the utilization of four display sub-pixels as the red display sub-pixel, green display sub-pixel, blue display sub-pixel and white display sub-pixel to represent two display pixels, i.e. one of the display pixels comprising the red display sub-pixel and the green display sub-pixel, and the other display pixel comprising the blue display sub-pixel and the white display sub-pixel. In addition, LG in Korea adopts another solution as utilizing five display sub-pixels as the red display sub-pixel, green display sub-pixel, blue display sub-pixel, white display sub-pixel and another red display sub-pixel to represent two display pixels. In other words, many display pixels share at least one display sub-pixel to spare the utilized number of the display sub-pixel in the display device layout, so as to effectively lower the cost of the display device. However, in comparison with a regular display device having three display sub-pixels as the red, green and blue one, the above technique has the problem that each display pixel only comprises fewer display sub-pixels, such that the resolution of the display device may be inferior to the resolution of the direct-row-type 4K panel. Alternatively, other solutions, such as the Gamut Mapping Algorithm (GMA) and the Sub-pixel Rendering (SPR), are utilized to assist for compensating the display pixels which share more than one display sub-pixel.

Therefore, it has become an important issue to provide a display method, a display device and a computer system which can effectively control different display units at different locations and different periods.

SUMMARY OF THE INVENTION

Therefore, the primary objective of the present invention is to provide a display method, a display device and a computer system which can effectively control different display units at different locations and different periods.

The present invention discloses a display method for a display device to display a display information, wherein the display device comprises a first display zone and a second display zone. The display method comprises receiving the display information to generate a first classification group display information and a second classification group display information; and displaying the first classification group display information at the first display zone in a first display period and displaying the second classification group display information at the second display zone in a second display period; wherein the display device corresponds to a matrix and a plurality of matrix units of the matrix correspond to a plurality of display units, such that the first display zone and the second display zone correspond to a plurality of display units, respectively, and the plurality of display units of the first display zone neighbor with the plurality of display units of the second display zone and all the display units are disposed at different matrix units with different column and/or row information.

The present invention further discloses a computer system coupled to a display device for displaying a display information, wherein the display device comprises a first display zone and a second display zone. The computer system comprises a central processing unit; and a storage device, coupled to the processing unit and storing a program code. The program code comprises a first instruction to receive the display information to generate a first classification group display information and a second classification group display information; and a second instruction to display the first classification group display information at the first display zone in a first display period and to display the second classification group display information at the second display zone in a second display period; wherein the display device corresponds to a matrix and a plurality of matrix units of the matrix correspond to a plurality of display units, such that the first display zone and the second display zone correspond to a plurality of display units, respectively, and the plurality of display units of the first display zone neighbor with the plurality of display units of the second display zone and all the display units are disposed at different matrix units with different column and/or row information.

The present invention further discloses a display device. The display device comprises a reception module, disposed to receive a display information to generate a first classification group display information and a second classification group display information; a processing unit, coupled to the reception module, disposed to generate a control signal; and a display panel, coupled to the reception module and the processing unit, comprising a first display zone and a second display zone, disposed to receive the control signal, the first classification group display information and the second classification group display information, so as to display the first classification group display information at the first display zone in a first display period and display the second classification group display information at the second display zone in a second display period; wherein the display device corresponds to a matrix and a plurality of matrix units of the matrix correspond to a plurality of display units, such that the first display zone and the second display zone correspond to a plurality of display units, respectively, and the plurality of display units of the first display zone neighbor with the plurality of display units of the second display zone and all the display units are disposed at different matrix units with different column and/or row information.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims, which refer to particular components. As one skilled in the art will appreciate, electronic equipment manufacturers may refer to a component by different names. This document does not intend to distinguish between components that differ in name but not in sub-module. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
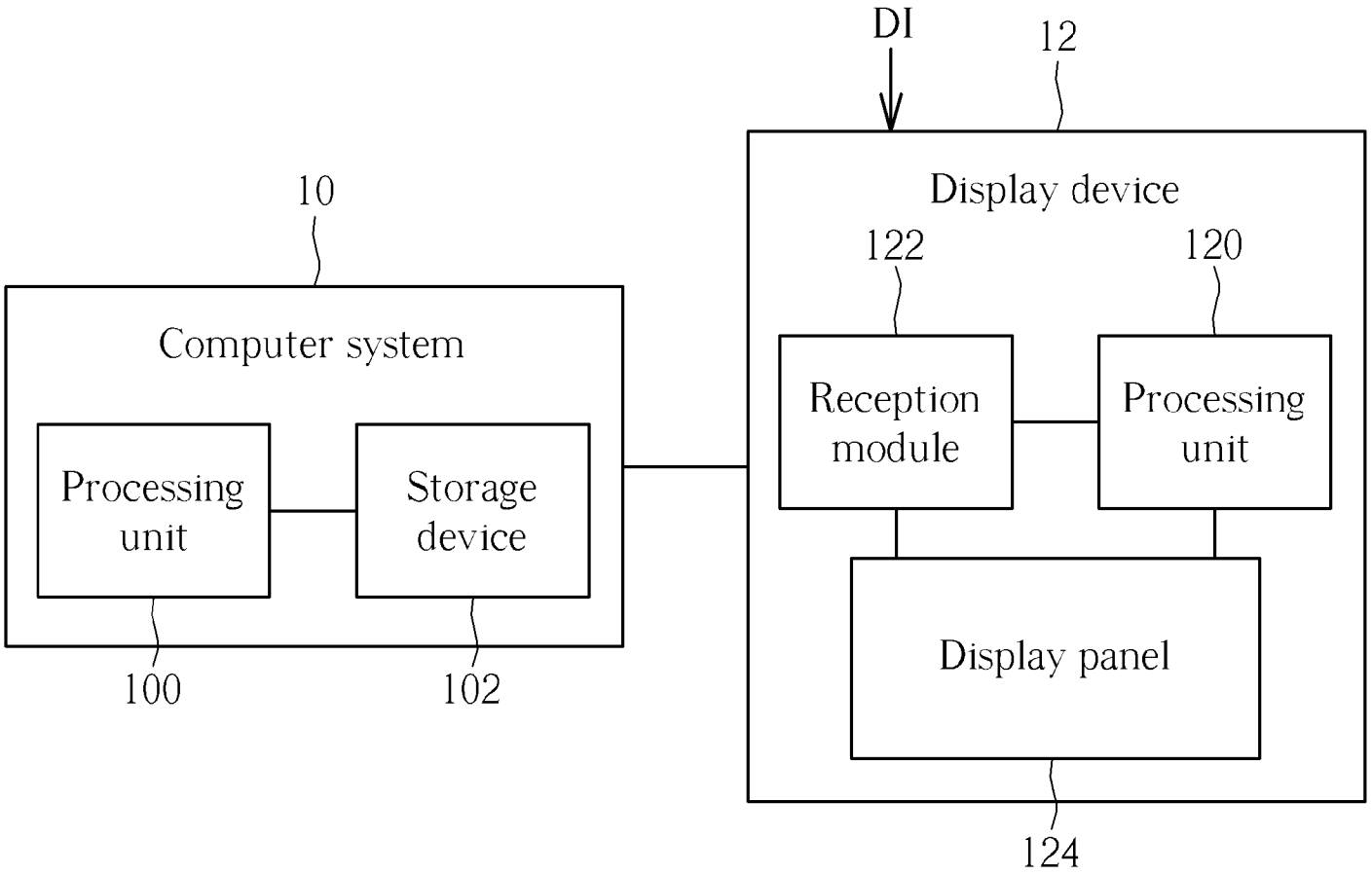
FIG. 1 illustrates a schematic diagram of a computer system coupled to a display device according to an embodiment of the invention.
Figure 3:
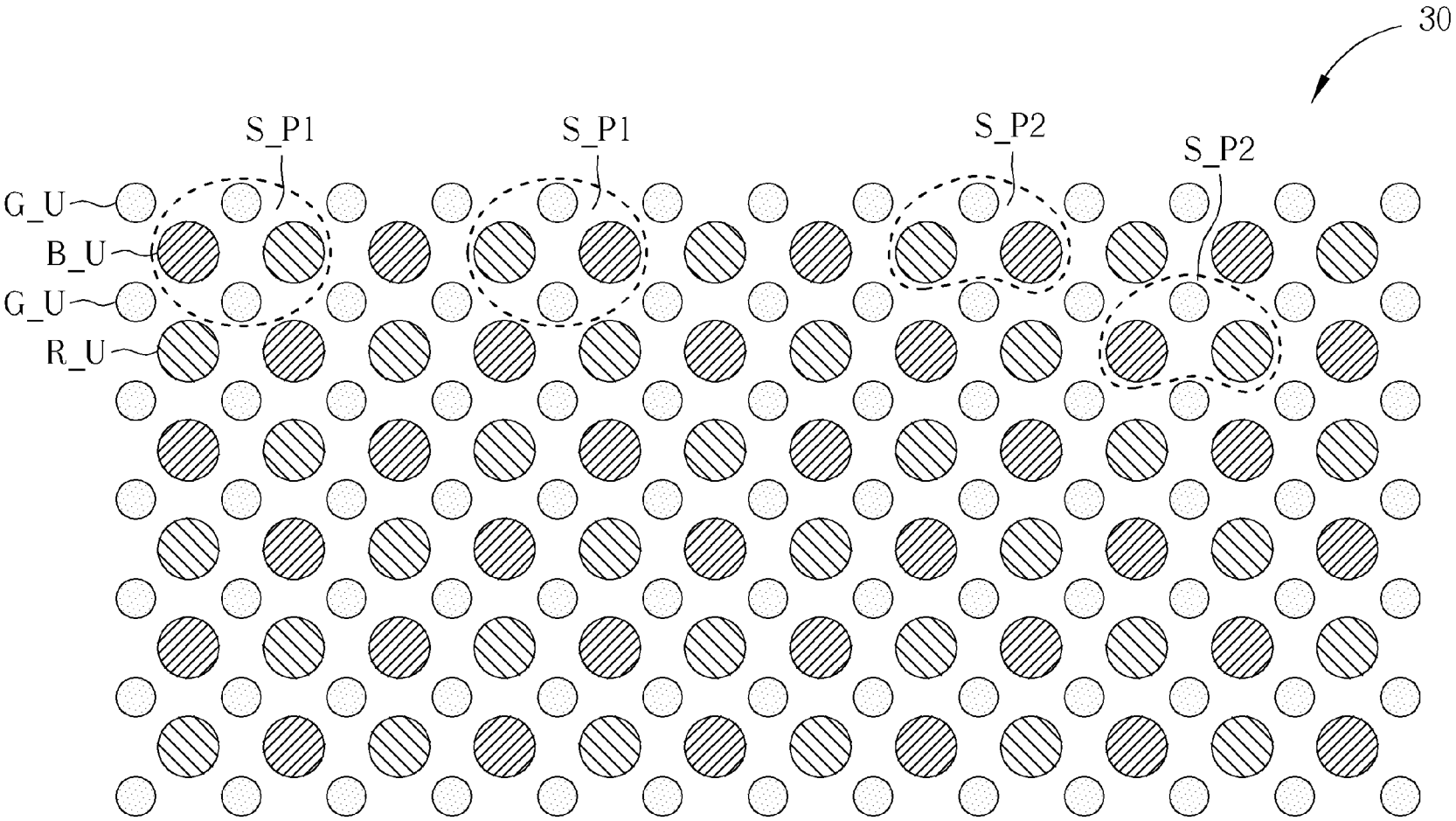
FIG. 3 illustrates a schematic diagram of a display panel according to an embodiment of the invention.

Please refer to FIG. 3, which illustrates a schematic diagram of a computer system 10 coupled to a display device 12 according to an embodiment of the invention. The computer system 10 of the embodiment has a basic structure comprising a main board, a processing unit, a memory, a hard disk, a south-bridge module, a north-bridge module, and etc., and should be well known to those skilled in the art. For the brevity, FIG. 1 of the invention only illustrates a processing unit 100 and a storage device 102 of the computer system 10. The storage device 102 can be, but not limited to, read-only memory (ROM), random-access memory (RAM), flash, floppy disk, hardware disk, compact disc, USB flash drive, tape, database accessed via the Internet, or other types of storage medium known to those skilled in the art, to store a program code, such that the processing unit 100 can be utilized to process the program code to operate a display method for the display device 12.

The display device 12 of the embodiment comprises a processing unit 120, a reception module 122 and a display panel 124. The reception module 122 receives the display information DI to generate the first classification group display information and the second classification group display information. The processing unit 120 is coupled to the reception module 122 to generate a control signal. The display panel 124 is coupled to the reception module 122 and the processing unit 120, and comprises a first display zone and a second display zone to receive the control signal, the first classification group display information and the second classification group display information, so as to adaptively display the first classification group display information and the second classification group display information. Preferably, the display panel 124 of the display device 12 corresponds to a matrix, and a plurality of matrix units of the matrix correspond to a plurality of display units, such that the first display zone and the second display zone correspond to a plurality of display units, respectively. The plurality of display units of the first display zone neighbor with the plurality of display units of the second display zone, and all the display units are disposed at different matrix units with different column and/or row information on the display device 12.

In short, the processing unit 100 of the computer system 10 in the embodiment can process the program code corresponding to the display method, to control operations of the processing unit 120, the reception module 122 and the display panel 124 of the display device 12 within different periods, such that the display units of the display panel 124 can proceed with the display operation for the display information DI. Certainly, those skilled in the art can directly integrate or store the program code corresponding to the display method inside the processing unit 120 of the display device 12, such that the display device 12 can independently process the display method of the invention without connecting to the computer system 10, which is also in the scope of the invention.

Figure 2:
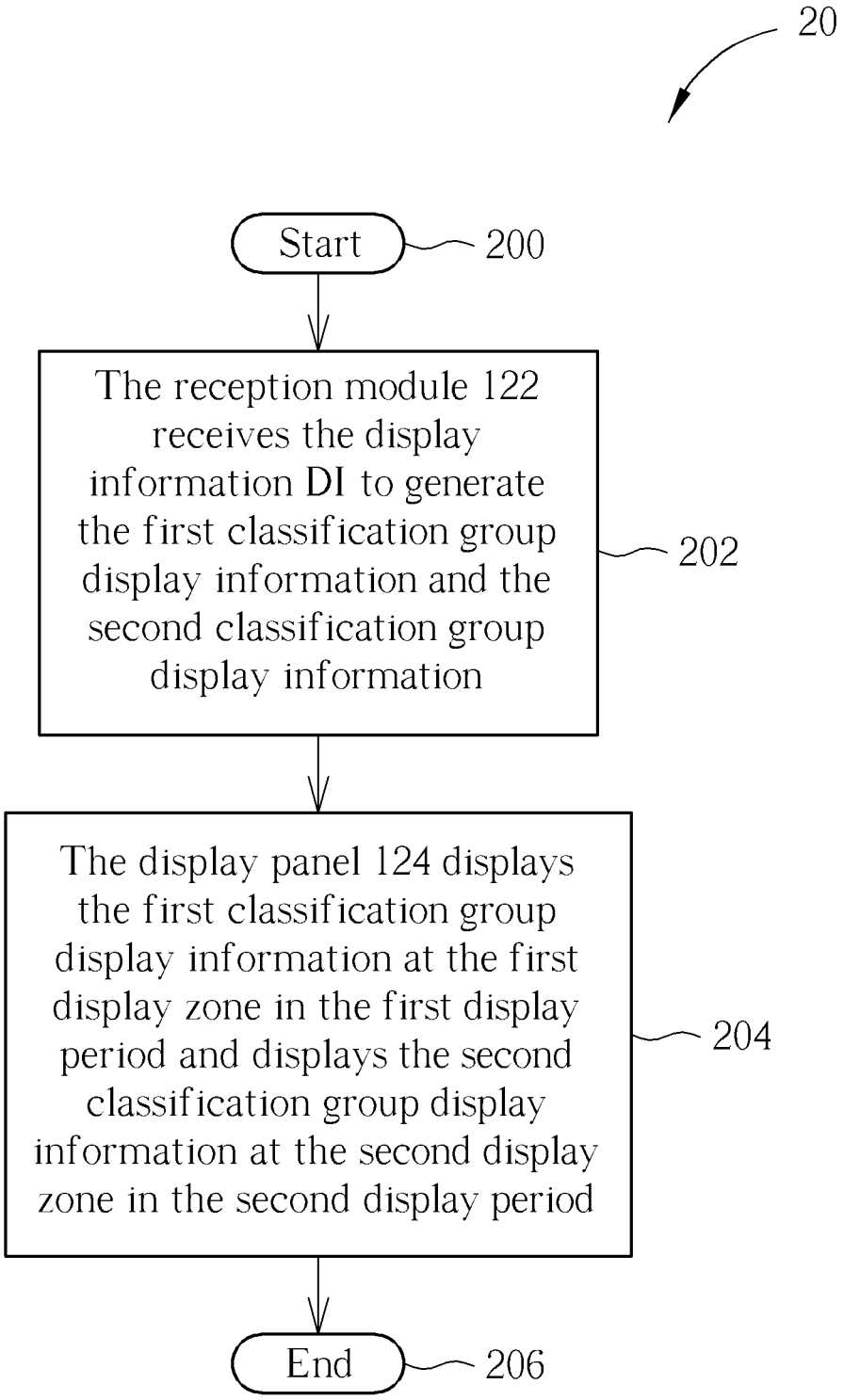
FIG. 2 illustrates a flowchart diagram of a display process according to an embodiment of the invention.

Further, the display method for the display device 12 can be summarized as a display process 20 to be stored as the program code in the storage device 102 (or inside the processing unit 120). The display process 20, as shown in FIG. 2, of the invention comprises the following steps:

Step 200: Start.

Step 202: The reception module 122 receives the display information DI to generate the first classification group display information and the second classification group display information.

Step 204: The display panel 124 displays the first classification group display information at the first display zone in the first display period and displays the second classification group display information at the second display zone in the second display period.

Step 206: End.

In step 202, as a first instruction, the reception module 122 of the embodiment receives the display information DI from an external signal source, and the display information DI can be a plurality of display sub-information derived from a multimedia signal. Each display sub-information corresponds to different matrix units related to the display units of the display panel 124. In other words, each display sub-information comprises a location information, and accordingly, the reception module 122 of the embedment divide the plurality of display sub-information into the first classification group display information and the second classification group display information according to the location information of the display sub-information, and transmit the first classification group display information and the second classification group display information to the display panel 124.

In step 204, as a second instruction, the display panel 124 of the embodiment displays the first classification group display information at the first display zone in the first display period and displays the second classification group display information at the second display zone in the second display period according to the control signal of the processing unit 120. In other words, the embodiment of the invention adopts a plurality of display sub-units, such as red display sub-units, green display sub-units, blue display sub-units and white display sub-units, to realize the group characteristic of display units. Also, the display panel 124 cooperates with the display process 20 to make the plurality of display sub-units, disposed at different display zones, display at different periods, and a corresponding frame rate of the display panel 124 can also be adjusted/modified to achieve the persistence of vision of the user, so as to complete the display operation of the display information DI. For example, if the display device 12 of the embodiment is required to display a display picture in every 1/60 second, the first display zone will complete the display operation within a 1/120 second and the second display zone will finish the display operation within another 1/120 second as well, and accordingly, the frame rate as 1/60 of the display device 12 is achieved. Herein, the frame rate in the embedment of the invention is only demonstrated as one example, which is not limiting the scope of the invention. Besides, the display units of the first/second display zone of the display panel 124 will be described in the following paragraphs to show the switching operations and the displaying sequences thereof, and only the plurality of display units of the display panel 124 are depicted in the following embodiments for clear descriptions.

Please refer to FIG. 3, which illustrates a schematic diagram of a display panel 30 according to an embodiment of the invention. As shown in FIG. 3, the display panel 30 of the embodiment comprises a plurality of red display sub-units R_U (i.e. zones where are marked with the oblique line from the upper left to the lower right), a plurality of green display sub-units G_U (i.e. zones where are marked with the dots) and a plurality of blue display sub-units B_U (i.e. zones where are marked with the oblique line from the lower left to the upper right). Each of the red display sub-units R_U or the blue display sub-units B_U is shown as a circle with larger radius, and each of the green display sub-units G_U is shown as a circle with smaller radius. The red display sub-units R_U and the blue display sub-units B_U are interlaced in arrangement, i.e. one blue display sub-unit B_U is disposed between every two red display sub-units R_U, and one red display sub-unit R_U is disposed between every two blue display sub-units B_U. Besides, each red display sub-unit R_U (or the blue display sub-unit B_U) has four green display sub-units G_U neighboring around, and the four green display sub-units G_U are disposed along two diagonal lines originated from the red display sub-unit R_U (or the blue display sub-unit B_U), which means that the green display sub-units G_U disposed at every two rows (or every two columns) are interlaced with one row red display sub-units R_U/blue display sub-units B_U or one column red display sub-units R_U/blue display sub-units B_U. Accordingly, each display unit of the embodiment comprises one red display sub-unit R_U, one blue display sub-unit B_U and one (or two) green display sub-unit(s) G_U and all are neighboring for arrangement, and herein are shown two embodiments as the display units S_P1 and S_P2, as circled in FIG. 3. Thus, the embodiment of the invention provides every two display units sharing more than one of the red display sub-units R_U, the blue display sub-units B_U and the green display sub-units G_U, which contributes to the smaller disposition number of the display sub-units.

Figure 4A:
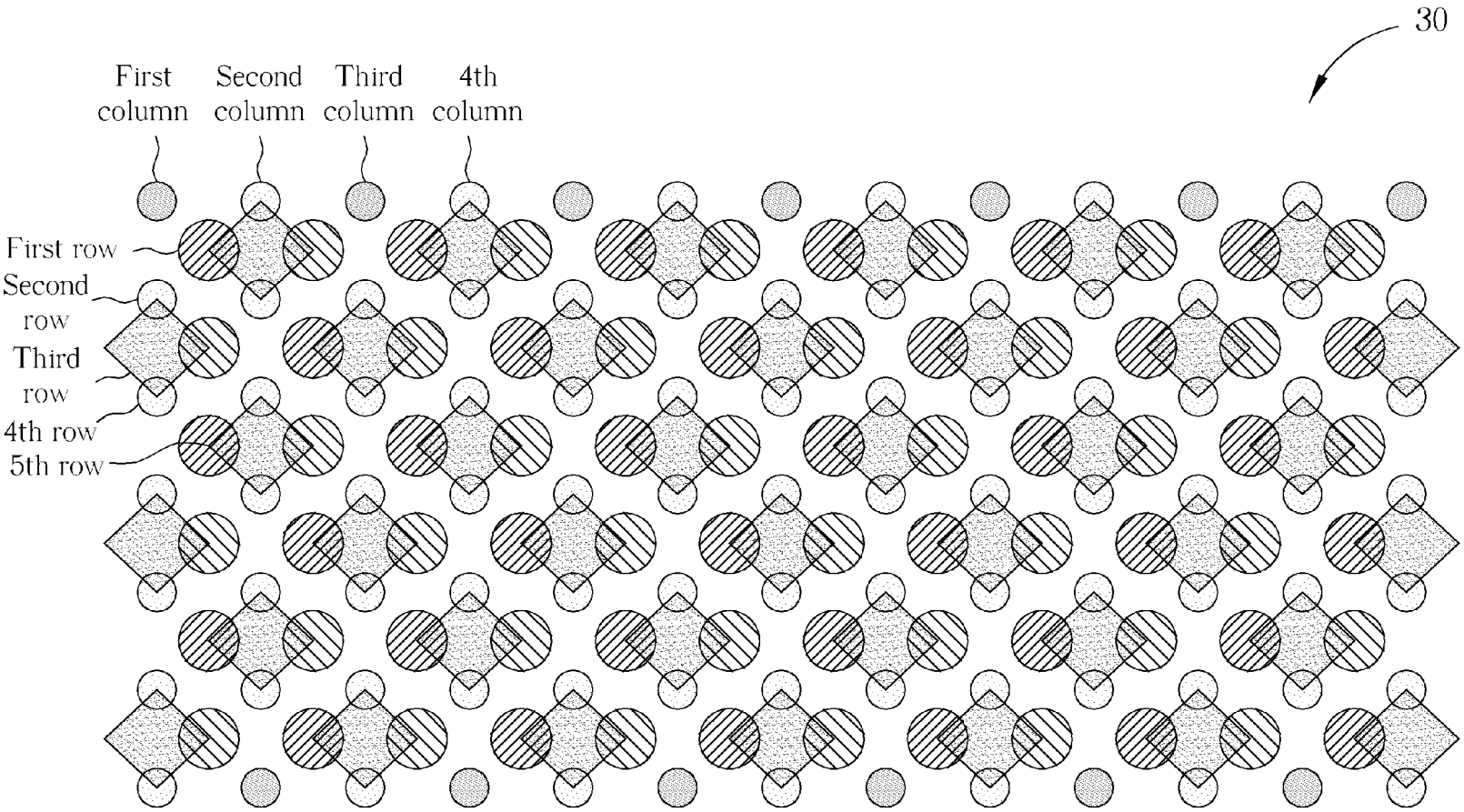
FIG. 4A and FIG. 4B illustrate schematic diagrams of different row/column display units on the display panel according to an embodiment of the invention.
Figure 4B:
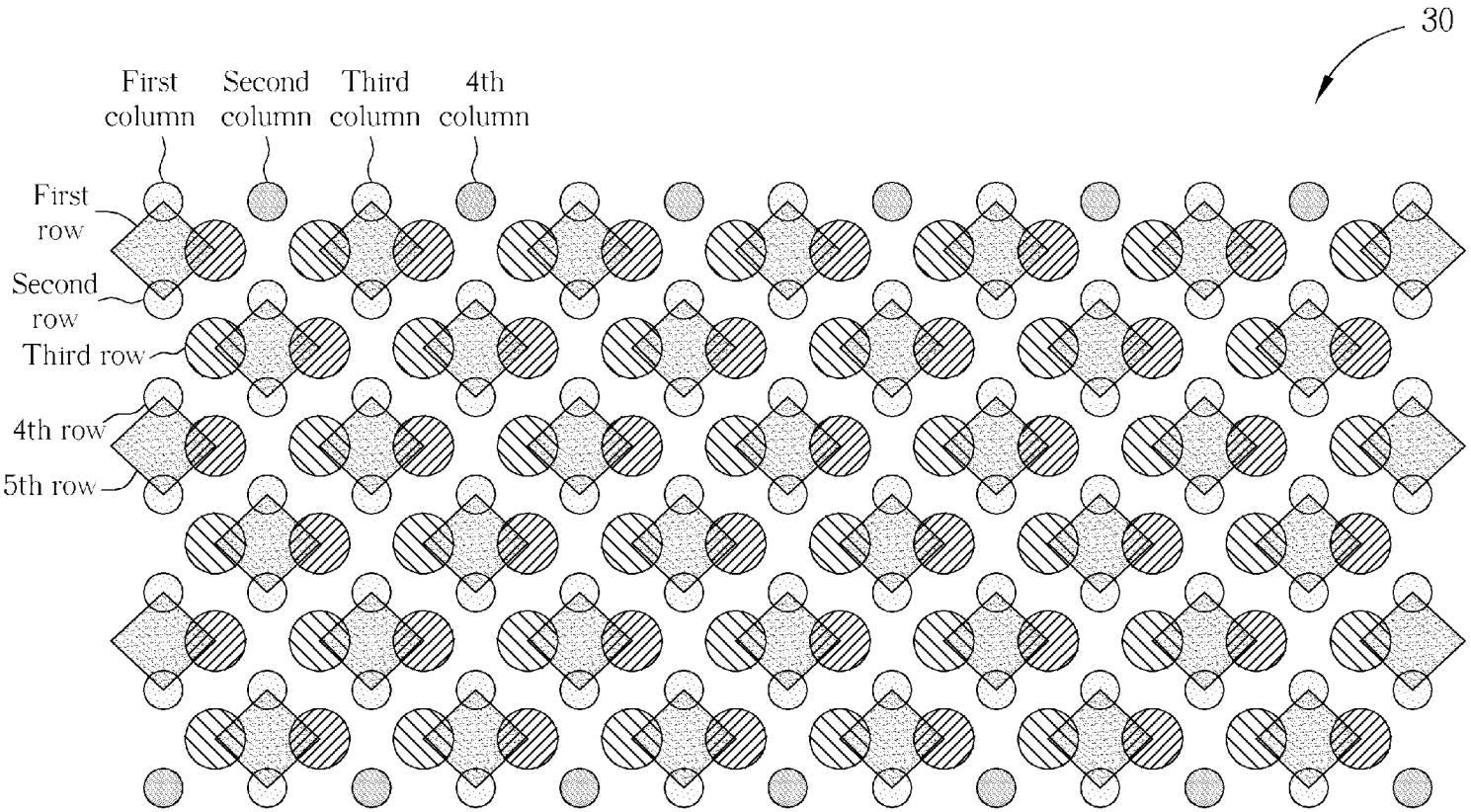

Please refer to FIG. 4A and FIG. 4B, wherein FIG. 4A and FIG. 4B illustrate schematic diagrams of different row/column display units S_P1 on the display panel 30 according to an embodiment of the invention, and the display units having the gray layer covered circle (s) are turned off. As shown in FIG. 4A, within the first display period, the display units S_P1 marked as the rhombus frames can be correspondingly turned on to show the first classification group display information, such as the display unit located at the first row and the second column, the display unit located at the first row and the 4th column (i.e. the display unit located at the first row and the even column), the display unit located at the second row and the first column, the display unit located at the second row and the third column (i.e. the display unit located at the second row and the even column), the display unit located at the third row and the second column, the display unit located at the third row and the 4th column (i.e. the display unit located at the third row and the even column), the display unit located at the 4th row and the first column, the display unit located at the 4th row and the third column (i.e. the display unit located at the 4th row and the even column), and so on. In other words, the plurality of display units being disposed at odd rows with even columns or at odd rows with even columns are adaptively controlled to process the display operation, such that four display sub-units are utilized to display the first classification group display information. As shown in FIG. 4B, within the second display period which is not equivalent to the first display period, the display units S_P1 marked as the rhombus frames can be correspondingly turned on to show the second classification group display information, such as the display unit located at the first row and the first column, the display unit located at the first row and the third column (i.e. the display unit located at the first row and the odd column), the display unit located at the second row and the second column, the display unit located at the second row and the 4th column (i.e. the display unit located at the second row and the even column), the display unit located at the third row and the first column, the display unit located at the third row and the third column (i.e. the display unit located at the third row and the odd column), the display unit located at the 4th row and the second column, the display unit located at the 4th row and the 4th column (i.e. the display unit located at the 4th row and the even column), and so on. In other words, the plurality of display units being disposed at odd rows with odd columns or at even rows with even columns are adaptively controlled to process the display operation, such that four display sub-units are utilized to display the second classification group display information.

Figure 5A:
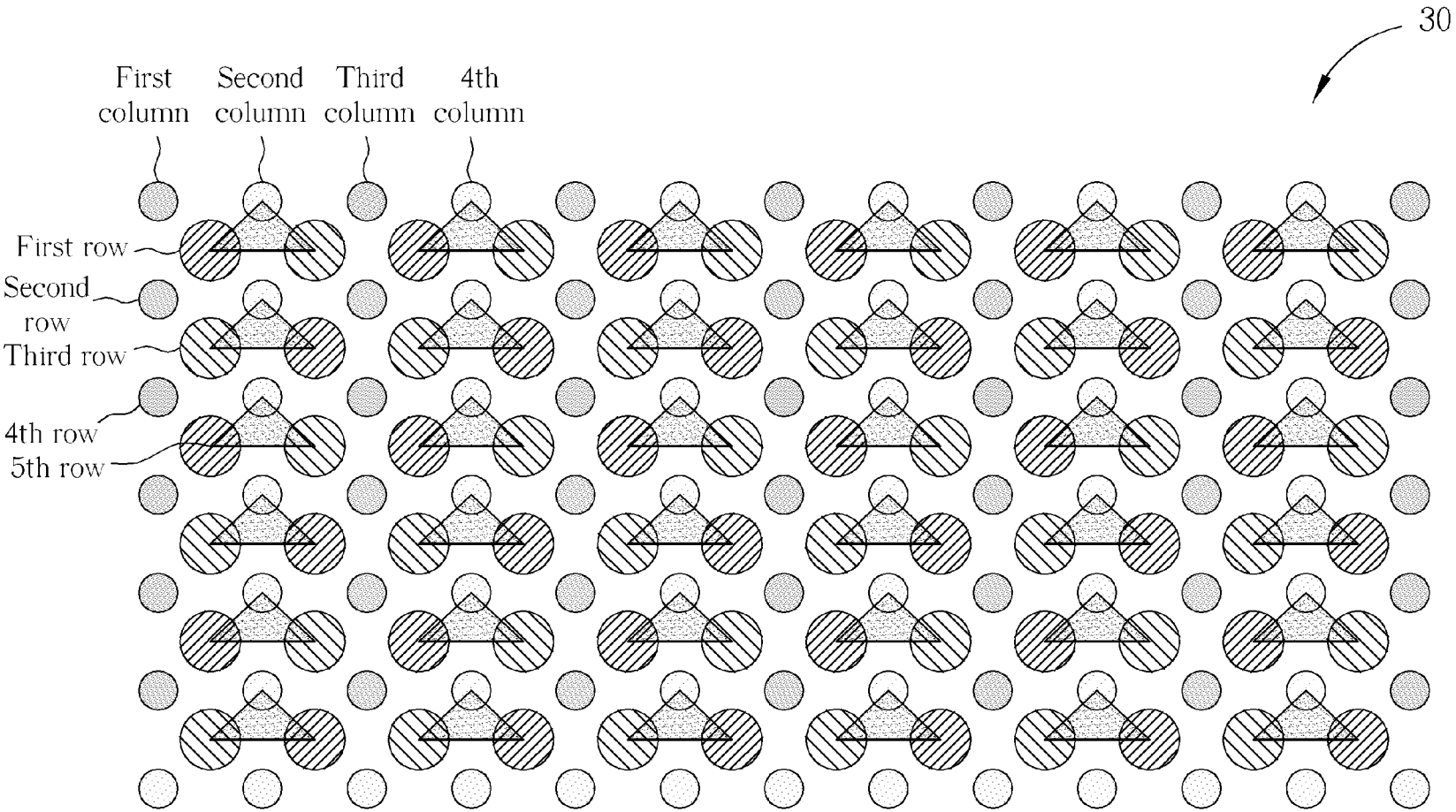
FIG. 5A and FIG. 5B illustrate schematic diagrams of different row/column display units on the display panel according to another embodiment of the invention.
Figure 5B:
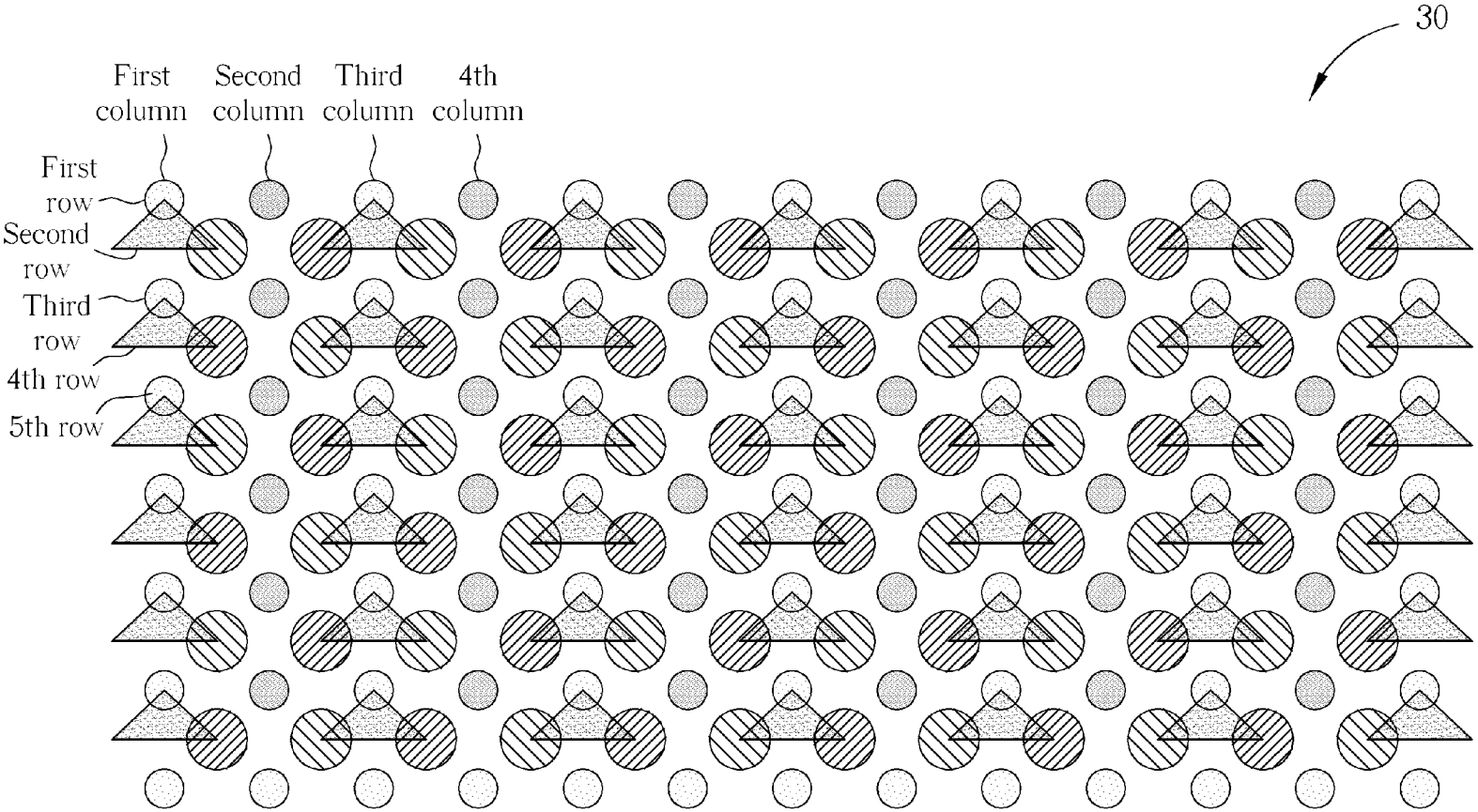

Please refer to FIG. 5A and FIG. 5B, wherein FIG. 5A and FIG. 5B illustrate schematic diagrams of different row/column display units S_P2 on the display panel 30 according to an embodiment of the invention. As shown in FIG. 5A, within the first display period, the display units S_P2 marked as the triangle frames can be correspondingly turned on to show the first classification group display information, such as the display units located at the second column, the display units located at the 4th column, the display units located at the 6th column, and so on. In other words, the plurality of display units being disposed at even columns are adaptively controlled to process the display operation, such that three display sub-units are utilized to display the first classification group display information. As shown in FIG. 5B, within the second display period which is not equivalent to the first display period, the display units S_P1 marked as the triangle frames can be correspondingly turned on to show the second classification group display information, such as the display units located at the first column, the display units located at the third column, the display units located at the 5th column, and so on. In other words, the plurality of display units being disposed at odd columns are adaptively controlled to process the display operation, such that three display sub-units are utilized to display the second classification group display information.

Accordingly, the display units S_P1 or S_P2 of the display panel 30 of the embodiment are classified into the first display zone and the second display zone according to the location information thereof, such that the display units disposed at the first display zone and the second display zone are operated for the display operation within the first display period and the second display period, which means the display sub-units at different columns or different rows can be adaptively turned on or off to achieve the UHD resolution display with a smaller total number of the display sub-units. Also, each display unit in the embodiment of the invention has at least one red/green/blue display sub-unit. In comparison, the prior art may neglects some of the display sub-units in order to comply with different requirements, or processes additional algorithms for calculation compensation of the display units. However, the display device in the embodiment of the invention only adaptively classifies the display zone of the display panel, to correspondingly turn on/off different display zones at different periods, so as to enlarge the application range of the high-resolution and large-size display devices.

Figure 6:
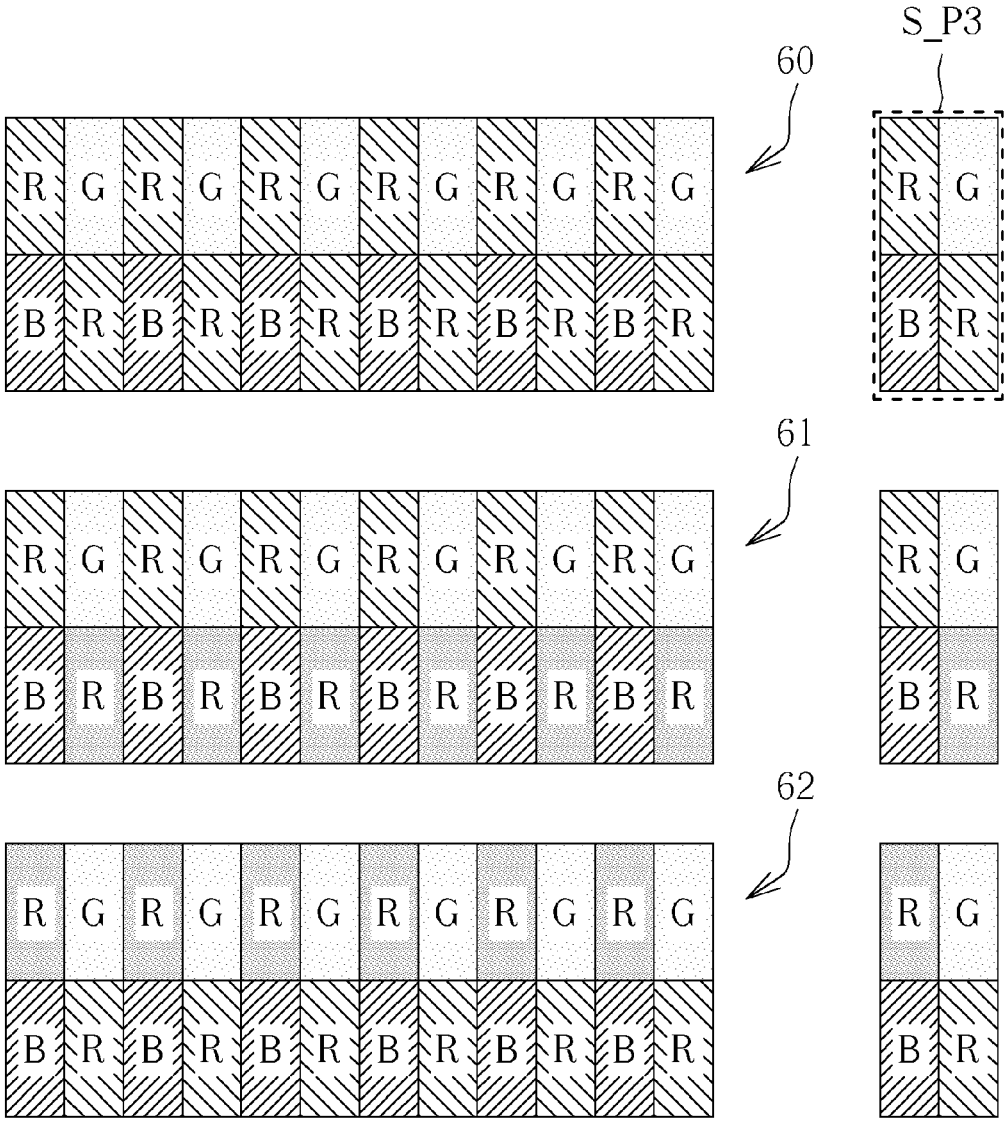
FIG. 6 to FIG. 10 illustrate schematic diagrams of another display panel according to an embodiment of the invention.

Furthermore, please refer to FIG. 6, which illustrates a schematic diagram of another display panel 60 according to an embodiment of the invention, wherein the display sub-unit is turned off with the square having the covered gray layer. As shown in FIG. 6, being different from the disposition of the display unit S_P1 or S_P2 in FIG. 3, the display panel 60 has the display unit S_P3 which also comprises four display sub-units to form a square matrix. The square matrix has two red display sub-units, one green display sub-unit and one blue display sub-unit, and the two red display sub-units are disposed on a diagonal line without contacting, and the green display sub-unit and the blue display sub-unit are disposed on another diagonal line. Under such circumstances, the display panel 60 of the invention has two possible embodiments, i.e. the display panel 61 to be shown within the first display period and the display panel 62 to be shown within the second display period. Also, the first display zone of the display panel 60 is disposed at the upper left corner of the display unit S_P3 (i.e. the lower right display sub-unit of the square matrix is turned off, and the other three display sub-units are turned on), and the second display zone of the display panel 60 is disposed at the lower right corner of the display unit S_P3 (i.e. the upper left display sub-unit of the square matrix is turned off, and the other three display sub-units are turned on). Accordingly, the user has the feeling that a lighting spot of the display unit S_P3 within the first display period is close to upper left and another lighting spot of the display unit S_P3 within the second display period is close to lower right. Under the switching of the first display period and the second display period, the persistence of vision of the user may sense that there are two row display units to be adaptively switched for the display operation. In short, the display panel 60 of the embodiment has the display units S_P3, which are neighboring each other with different locations as the upper left first display zone and the lower right second display zone, can be adaptively turned on or off to proceed with the display operation of the display information DI within the first display period and the second display period, so as to realize the display onto the high-resolution and large-size display devices.

Figure 7:
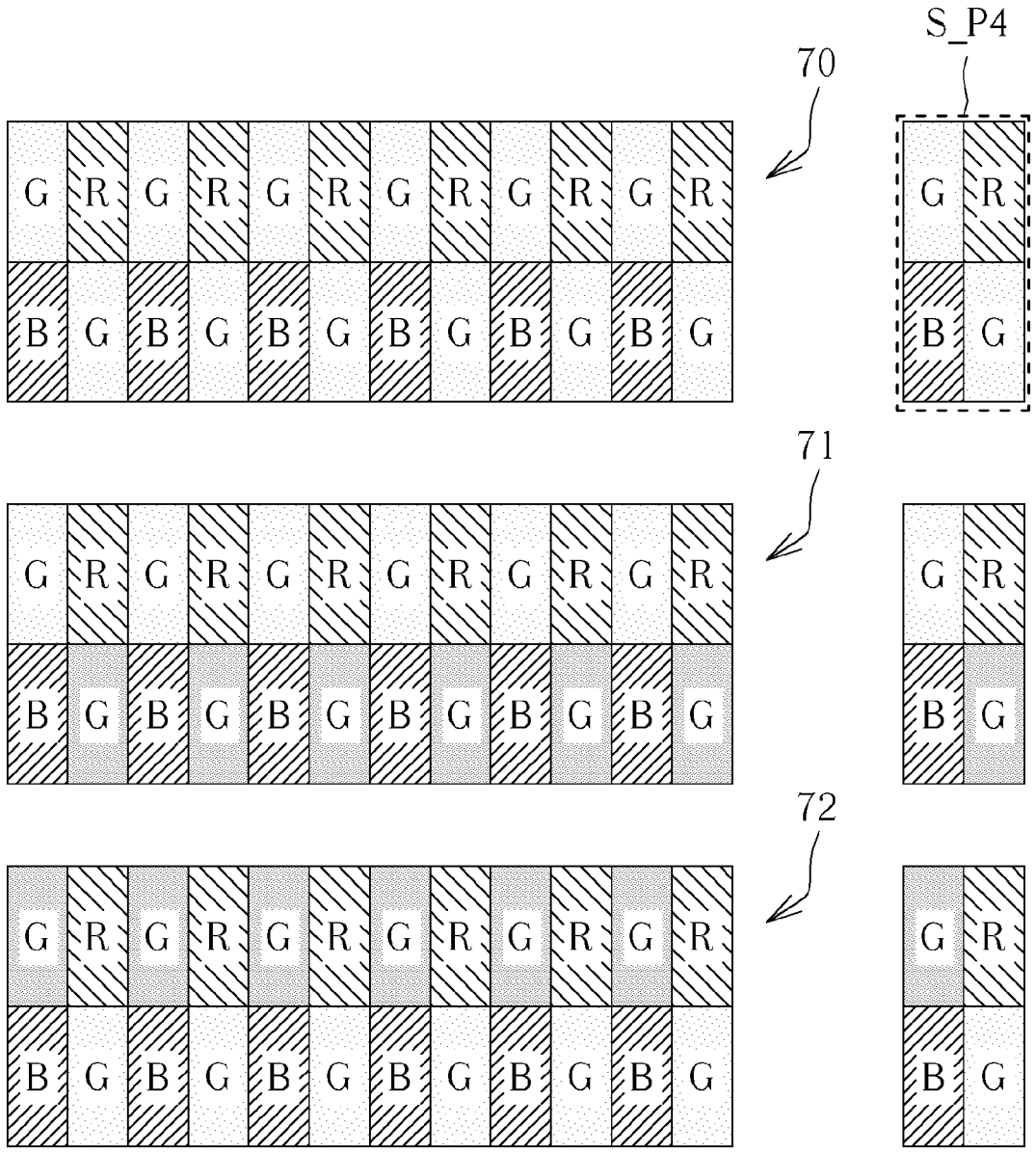

Moreover, please refer to FIG. 7, which illustrates a schematic diagram of another display panel 70 according to an embodiment of the invention, wherein the display sub-unit is turned off with the square having the covered gray layer. As shown in FIG. 7, being similar to the display unit S_P3 of the display panel 60 in FIG. 6, the display panel 70 also has the display unit S_P4 comprising four display sub-units to form the square matrix. The square matrix has one red display sub-unit, two green display sub-units and one blue display sub-unit, and the two green display sub-units are disposed on a diagonal line without contacting, and the red display sub-unit and the blue display sub-unit are disposed on another diagonal line. Under such circumstances, the display panel 70 of the invention has two possible embodiments, i.e. the display panel 71 to be shown within the first display period and the display panel 72 to be shown within the second display period. Also, the first display zone of the display panel 70 is disposed at the upper left corner of the display unit S_P4 (i.e. the lower right display sub-unit of the square matrix is turned off, and the other three display sub-units are turned on), and the second display zone of the display panel 70 is disposed at the lower right corner of the display unit S_P4 (i.e. the upper left display sub-unit of the square matrix is turned off, and the other three display sub-units are turned on). Accordingly, the user has the feeling that a lighting spot of the display unit S_P4 within the first display period is close to upper left and another lighting spot of the display unit S_P4 within the second display period is close to lower right. Under the switching of the first display period and the second display period, the persistence of vision of the user may sense that there are two row display units to be adaptively switched for the display operation. In short, the display panel 70 of the embodiment has the display units S_P4, which are neighboring each other with different locations as the upper left first display zone and the lower right second display zone, can be adaptively turned on or off to proceed the display operation of the display information DI within the first display period and the second display period, so as to realize the display onto the high-resolution and large-size display devices.

Figure 8:
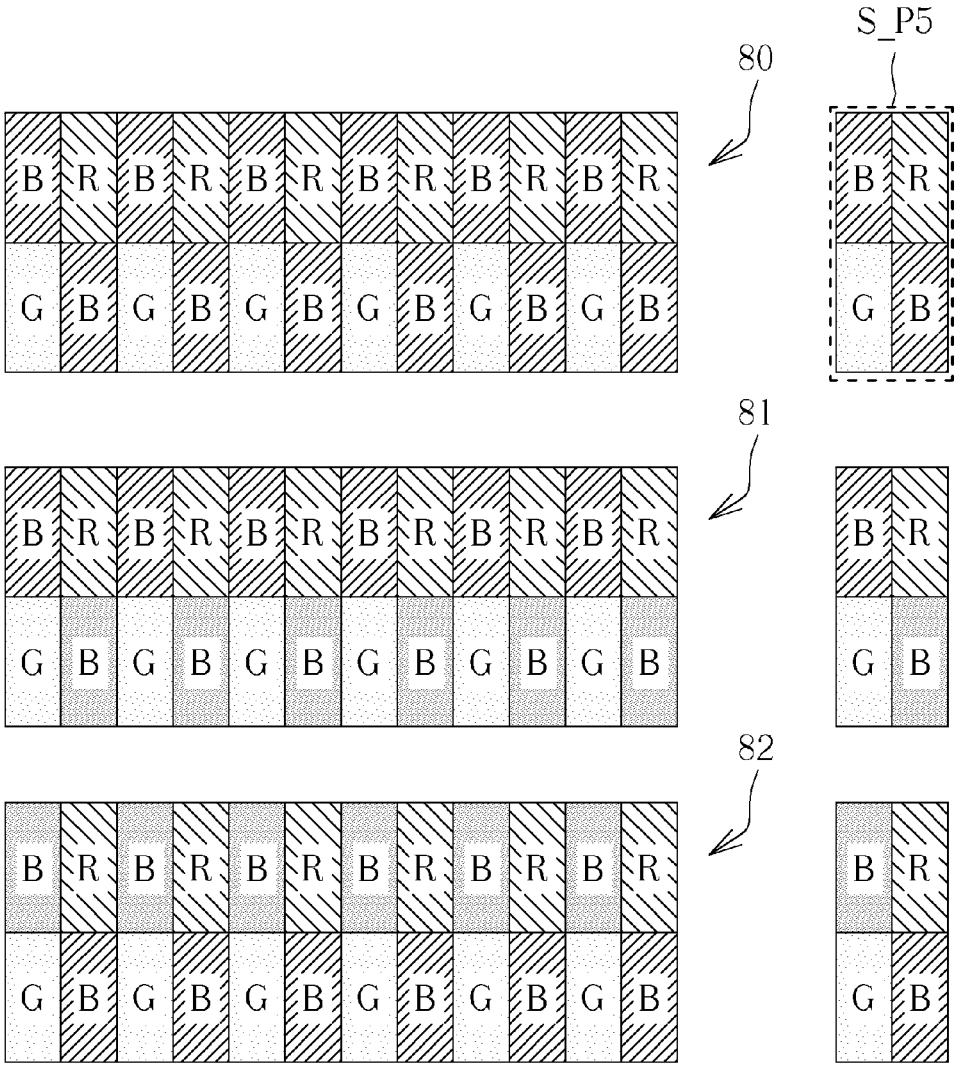

Besides, please refer to FIG. 8, which illustrates a schematic diagram of another display panel 80 according to an embodiment of the invention, wherein the display sub-unit is turned off with the square having the covered gray layer. As shown in FIG. 8, being similar to the display unit S_P3 of the display panel 60 in FIG. 6, the display panel 80 also has the display unit S_P5 comprising four display sub-units to form the square matrix. The square matrix has one red display sub-unit, one green display sub-unit and two blue display sub-units, and the two blue display sub-units are disposed on a diagonal line without contacting, and the red display sub-unit and the green display sub-unit are disposed on another diagonal line. Under such circumstances, the display panel 80 of the invention has two possible embodiments, i.e. the display panel 81 to be shown within the first display period and the display panel 82 to be shown within the second display period. Also, the first display zone of the display panel 80 is disposed at the upper left corner of the display unit S_P5 (i.e. the lower right display sub-unit of the square matrix is turned off, and the other three display sub-units are turned on), and the second display zone of the display panel 80 is disposed at the lower right corner of the display unit S_P5 (i.e. the upper left display sub-unit of the square matrix is turned off, and the other three display sub-units are turned on). Accordingly, the user has the feeling that a lighting spot of the display unit S_P5 within the first display period is close to upper left and another lighting spot of the display unit S_P5 within the second display period is close to lower right. Under the switching of the first display period and the second display period, the persistence of vision of the user may sense that there are two row display units to be adaptively switched for the display operation. In short, the display panel 80 of the embodiment has the display units S_P5, which are neighboring each other with different locations as the upper left first display zone and the lower right second display zone, can be adaptively turned on or off to proceed with the display operation of the display information DI within the first display period and the second display period, so as to realize the display onto the high-resolution and large-size display devices.

Figure 9:
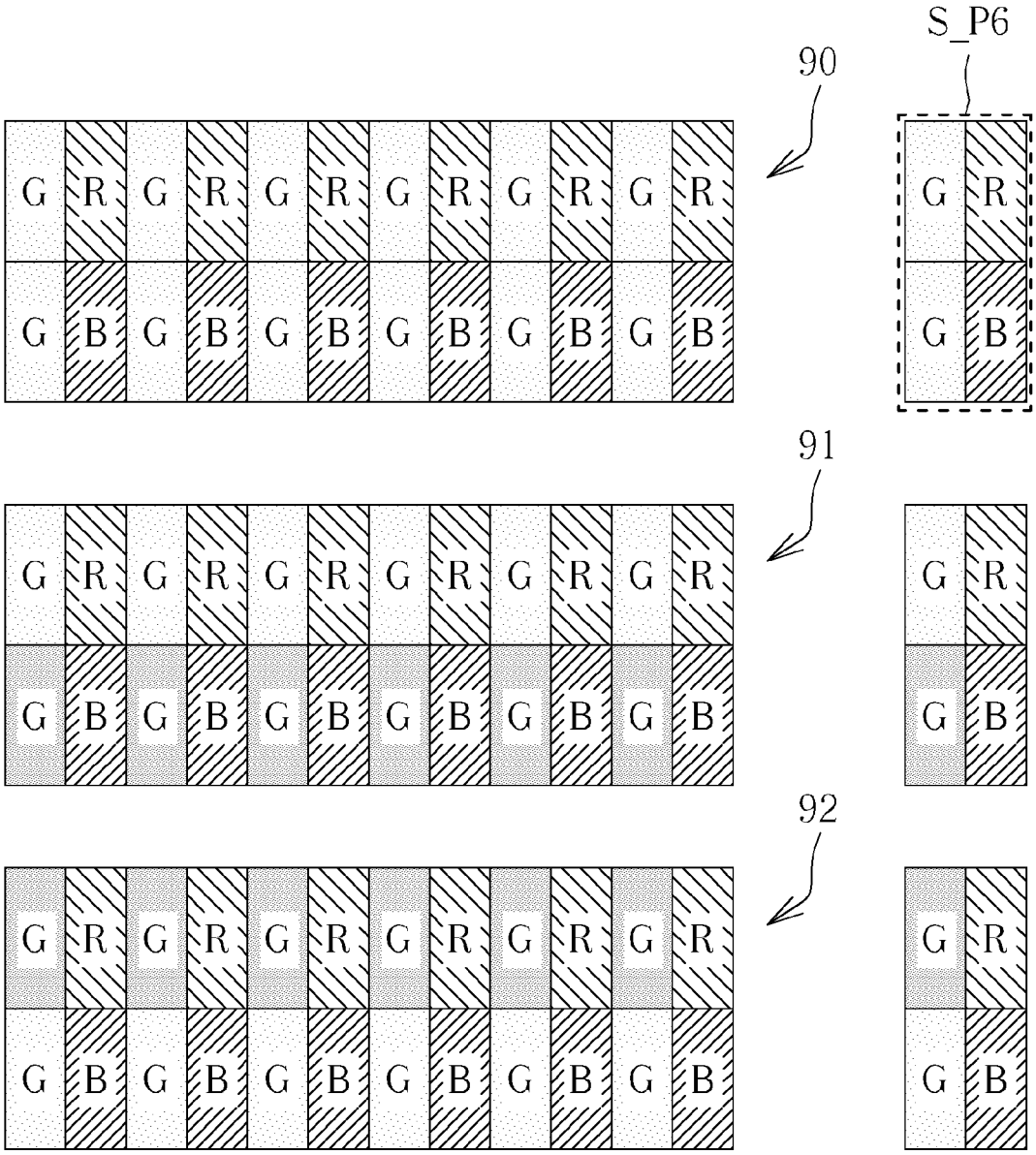

In addition, please refer to FIG. 9, which illustrates a schematic diagram of another display panel 90 according to an embodiment of the invention, wherein the display sub-unit is turned off with the square having the covered gray layer. As shown in FIG. 9, being similar to the display unit S_P3 of the display panel 60 in FIG. 6, the display panel 90 also has the display unit S_P6 comprising four display sub-units to form the square matrix. The square matrix has one red display sub-unit, two green display sub-units and one blue display sub-unit, and the two green display sub-units are disposed on a vertical line without contacting, and the red display sub-unit and the blue display sub-unit are disposed on another vertical line. Under such circumstances, the display panel 90 of the invention has two possible embodiments, i.e. the display panel 91 to be shown within the first display period and the display panel 92 to be shown within the second display period. Also, the first display zone of the display panel 90 is disposed at the upper right corner of the display unit S_P6 (i.e. the lower left display sub-unit of the square matrix is turned off, and the other three display sub-units are turned on), and the second display zone of the display panel 90 is disposed at the lower right corner of the display unit S_P6 (i.e. the upper left display sub-unit of the square matrix is turned off, and the other three display sub-units are turned on). Accordingly, the user has the feeling that a lighting spot of the display unit S_P6 within the first display period is close to upper right and another lighting spot of the display unit S_P6 within the second display period is close to lower right. Under the switching of the first display period and the second display period, the persistence of vision of the user may sense that there are two row display units to be adaptively switched for the display operation. In short, the display panel 90 of the embodiment has the display units S_P6, which are neighboring each other with different locations as the upper right first display zone and the lower right second display zone, can be adaptively turned on or off to proceed the display operation of the display information DI within the first display period and the second display period, so as to realize the display onto the high-resolution and large-size display devices.

Noticeably, the embodiments shown in FIG. 6 to FIG. 9 have the display units each comprising four display sub-units with different location information, such as the different color sub-units being disposed along the diagonal line or the vertical line, to be adaptively turned on/off at different periods, so as to have the persistence of vision of the user at the upper left position with the lower right position of the display unit or at the upper right position with the lower left position of the display unit. Certainly, the disposition of the display sub-units in these embodiments is only demonstrated as the examples, and those skilled in the art can adaptively modify the designs or layouts of the disposition of the display sub-units to be sequentially turned on or off by switching the first display period or the second display period, such that the display units located at every two rows/columns may be adaptively turned on or off for the display operation, which is also within the scope of the invention.

Figure 10:
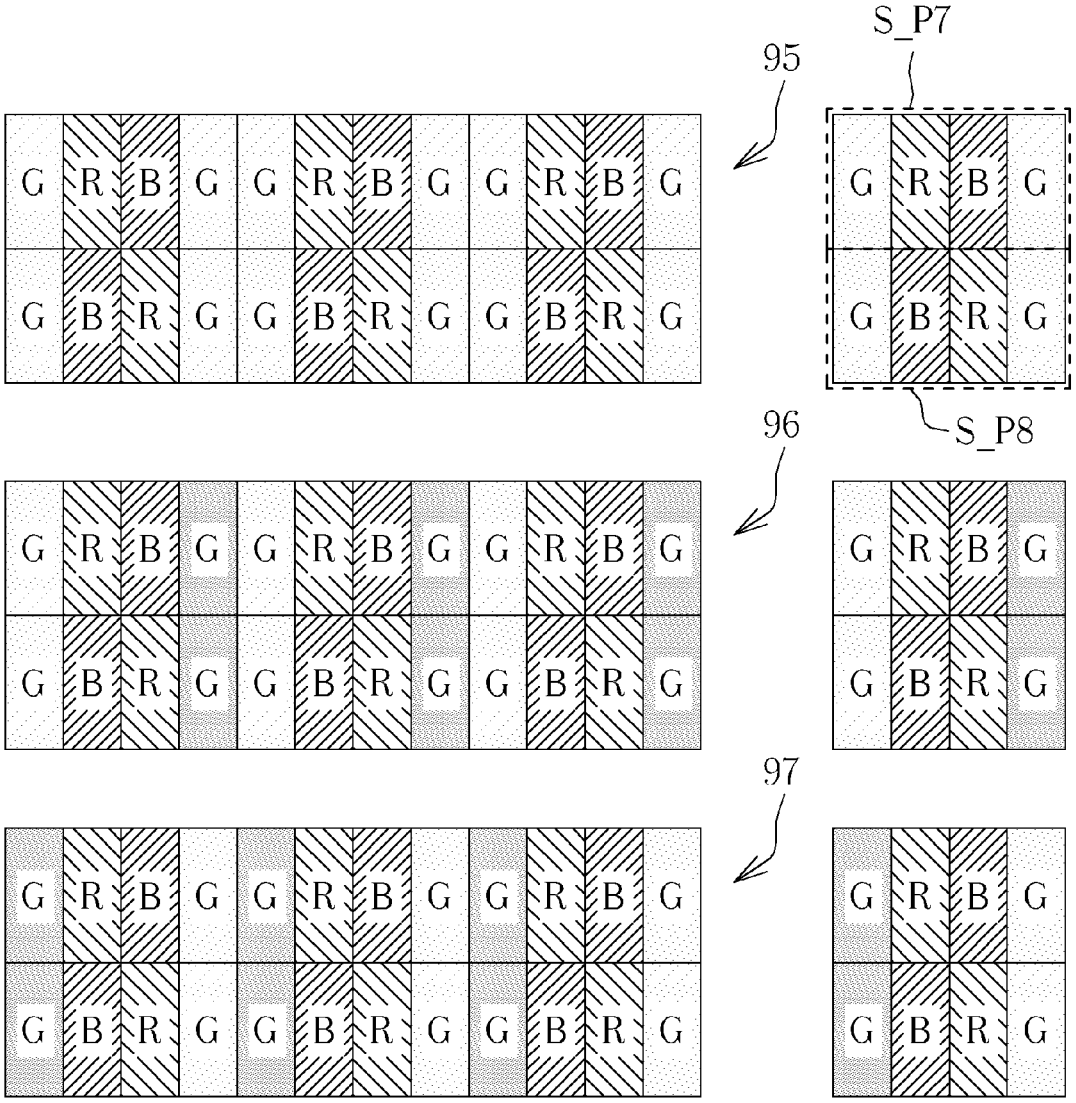

Additionally, please refer to FIG. 10, which illustrates a schematic diagram of another display panel 95 according to an embodiment of the invention, wherein the display sub-unit is turned off with the square having the covered gray layer. As shown in FIG. 10, the display panel 95 of the embodiment has eight display sub-units to form the display unit S_P7 and the display unit S_P8. The display unit S_P7 or the display unit S_P8 has its composition units to be horizontally disposed, and the display units S_P7 and S_P8 are vertically disposed to each other to form a square matrix. Both the display units S_P7 and S_P8 comprise one red display sub-unit, two green display sub-units and one blue display sub-unit. In detail, the display unit S_P7 has a horizontal arrangement as the green display sub-unit, the red display sub-unit, the blue display sub-unit and the green display sub-unit, and the display unit S_P8 has a horizontal arrangement as the green display sub-unit, the blue display sub-unit, the red display sub-unit and the green display sub-unit. Under such circumstances, the display panel 95 of the invention has two possible embodiments, i.e. the display panel 96 to be shown within the first display period and the display panel 97 to be shown within the second display period. Also, the first display zone of the display panel 90 is disposed at the left parts of the display units S_P7 and S_P8 (i.e. the rightward green display sub-unit both in two rows of the square matrix are turned off, and the other display sub-units are turned on), and the second display zone of the display panel 95 is disposed at the right parts of the display units S_P7 and S_P8 (i.e. the leftward green display sub-unit both in two rows of the square matrix are turned off, and the other display sub-units are turned on). Accordingly, the user has the feeling that a lighting spot of the display units S_P7 and S_P8 within the first display period is close to left and another lighting spot of the display units S_P7 and S_P8 within the second display period is close to right. Under the switching of the first display period and the second display period, the persistence of vision of the user may sense that there are two column display units to be adaptively switched for the displaying operation. In short, the display panel 95 of the embodiment has the display units S_P7 and S_P8, which are neighboring each other with different locations as the left first display zone and the right second display zone, can be adaptively turned on or off to proceed with the display operation of the display information DI within the first display period and the second display period, so as to realize the display onto the high-resolution and large-size display devices.

Noticeably, the embodiment shown in FIG. 10 has two display units (each display unit comprises four display sub-units) with different location information of the sub-units to be adaptively turned on/off at different periods, so as to have the persistence of vision of the user with horizontal shift of the two display units. Certainly, the disposition of the display sub-units in the embodiments is only demonstrated as the examples, and those skilled in the art can adaptively modify the designs or layouts of the disposition of the display sub-units to be sequentially turned on or off by switching the first display period or the second display period, such that the display units located at every two rows/columns may be adaptively turned on or off for the display operation, which is also within the scope of the invention.

In comparison with the prior art, the embodiments depicted in FIG. 3 to FIG. 10 of the invention have the characteristics that many display units share at least one display sub-unit, which means that the smaller total number of the display sub-units in the display device of the invention can be anticipated to realize the UHD resolution for the display operation. Each display unit comprises at least one red/green/blue display sub-unit, and accordingly, the embodiments of the invention are not necessary to neglect any display sub-unit in each display unit and additional algorithms corresponding to the calculation compensation for the display units can be omitted as well. By adaptively classifying/arranging the display zones on the display panel with the different location/disposition information, such as the diagonal disposition, the horizontal disposition or the vertical disposition, of the different color display sub-units, the display units at different display zones can be correspondingly turned on or off with different frame rates within the first/second display period, to achieve the requirement of the high-resolution and large-size display devices. Certainly, those skilled in the art can adaptively combine the embodiments shown in FIG. 3 to FIG. 10 to simultaneously have the layout comprising the diagonal disposition, the horizontal disposition and the vertical disposition for the display sub-units, or the number of the display sub-units in each display unit can also be adjusted to comply with different resolutions or different sizes of the display devices, which is not limiting the scope of the invention.

In summary, the embodiments of the invention provide the display method and the computer system for the display device. The embodiments have the advantage that many display units can share at least one of the display sub-units (e.g. the red display sub-unit, the green display sub-unit, and blue display sub-unit and the white display sub-unit), and the display sub-units equipped with different location/disposition information (e.g. the diagonal disposition, the horizontal disposition and the vertical disposition) can be correspondingly turned on/off within different periods at different display zones. In addition, the embodiments of the invention can adjust the display period of the display device by changing the frame rate, to complete the persistence of vision of the user, so as to effectively realize the display operation of the high-resolution and large-size display devices, which also contributes the advantage as reducing the cost and enlarging the application range of the display devices.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display method for a display device to display a display information, wherein the display device comprises a first display zone and a second display zone, the display method comprising:

receiving the display information to generate a first classification group display information and a second classification group display information; and displaying the first classification group display information at the first display zone in a first display period and displaying the second classification group display information at the second display zone in a second display period;

wherein the display device corresponds to a matrix and a plurality of matrix units of the matrix correspond to a plurality of display units, such that the first display zone and the second display zone correspond to a plurality of display units, respectively, and the plurality of display units of the first display zone neighbor with the plurality of display units of the second display zone and all the display units are disposed at different matrix units with different column and/or row information;

wherein each display unit further comprises a red display sub-unit, a blue display sub-unit and a green display sub-unit, and a first display unit of the first display zone neighbors with a second display unit of the second display zone to share one of the red display sub-unit, the blue display sub-unit and the green display sub-unit, such that the first classification group display information or the second classification group display information is displayed in the first display period or the second display period, respectively.

2. The display method of claim 1, wherein the plurality of display units of the first display zone are disposed at odd rows with even columns or at odd rows with even columns, and the plurality of display units of the second display zone are disposed at odd rows with odd columns or at even rows with even columns.

3. The display method of claim 1, wherein the plurality of display units of the first display zone are all disposed at odd rows and the plurality of display units of the second display zone are all disposed at even rows, or the plurality of display units of the first display zone are all disposed at odd columns and the plurality of display units of the second display zone are all disposed at even columns.

4. The display method of claim 1, wherein the first display unit and the second display unit are disposed along a diagonal line, a horizontal line or a vertical line.

5. A computer system, coupled to a display device for displaying a display information, wherein the display device comprises a first display zone and a second display zone, the computer system comprising:

a processing unit; and a storage device, coupled to the processing unit and storing a program code, the program code comprising:

a first instruction to receive the display information to generate a first classification group display information and a second classification group display information; and a second instruction to display the first classification group display information at the first display zone in a first display period and to display the second classification group display information at the second display zone in a second display period;

wherein the display device corresponds to a matrix and a plurality of matrix units of the matrix correspond to a plurality of display units, such that the first display zone and the second display zone correspond to a plurality of display units, respectively, and the plurality of display units of the first display zone neighbor with the plurality of display units of the second display zone and all the display units are disposed at different matrix units with different column and/or row information;

wherein each display unit further comprises a red display sub-unit, a blue display sub-unit and a green display sub-unit, and a first display unit of the first display zone neighbors with a second display unit of the second display zone to share one of the red display sub-unit, the blue display sub-unit and the green display sub-unit, such that the first classification group display information or the second classification group display information is displayed in the first display period or the second display period, respectively.

6. The computer system of claim 5, wherein the plurality of display units of the first display zone are disposed at odd rows with even columns or at odd rows with even columns, and the plurality of display units of the second display zone are disposed at odd rows with odd columns or at even rows with even columns.

7. The computer system of claim 5, wherein the plurality of display units of the first display zone are all disposed at odd rows and the plurality of display units of the second display zone are all disposed at even rows, or the plurality of display units of the first display zone are all disposed at odd columns and the plurality of display units of the second display zone are all disposed at even columns.

8. The computer system of claim 5, wherein the first display unit and the second display unit are disposed along a diagonal line, a horizontal line or a vertical line.

9. A display device, comprising:

a reception module, disposed to receive a display information to generate a first classification group display information and a second classification group display information;

a processing unit, coupled to the reception module, disposed to generate a control signal; and a display panel, coupled to the reception module and the processing unit, comprising a first display zone and a second display zone, disposed to receive the control signal, the first classification group display information and the second classification group display information, so as to display the first classification group display information at the first display zone in a first display period and display the second classification group display information at the second display zone in a second display period;

wherein the display device corresponds to a matrix and a plurality of matrix units of the matrix correspond to a plurality of display units, such that the first display zone and the second display zone correspond to a plurality of display units, respectively, and the plurality of display units of the first display zone neighbor with the plurality of display units of the second display zone and all the display units are disposed at different matrix units with different column and/or row information;

wherein each display unit further comprises a red display sub-unit, a blue display sub-unit and a green display sub-unit, and a first display unit of the first display zone neighbors with a second display unit of the second display zone to share one of the red display sub-unit, the blue display sub-unit and the green display sub-unit, such that the first classification group display information or the second classification group display information is displayed in the first display period or the second display period, respectively.

10. The display device of claim 9, wherein the plurality of display units of the first display zone are disposed at odd rows with even columns or at odd rows with even columns, and the plurality of display units of the second display zone are disposed at odd rows with odd columns or at even rows with even columns.

11. The display device of claim 9, wherein the plurality of display units of the first display zone are all disposed at odd rows and the plurality of display units of the second display zone are all disposed at even rows, or the plurality of display units of the first display zone are all disposed at odd columns and the plurality of display units of the second display zone are all disposed at even columns.

12. The display device of claim 9, wherein the first display unit and the second display unit are disposed along a diagonal line, a horizontal line or a vertical line.

* * * * *